US005651451A

United States Patent [19]

Castonguay et al.

[11] Patent Number: 5,651,451

[45] Date of Patent: Jul. 29, 1997

[54] SYSTEM FOR RESETTING HIGH AMPERE-RATED CIRCUIT BREAKER OPERATING SPRINGS

[76] Inventors: Roger Neil Castonguay, 5 Ellen Dr., Terryville, Conn. 06786; James Lawrence Rosen, 478 Fern St., West Hartford, Conn. 06107; Mark Albino Zaffetti, 10 Town Line Rd., Windsor Locks, Conn. 06096

[21] Appl. No.: 613,801

[22] Filed: Mar. 1, 1996

Related U.S. Application Data

[63] Continuation-in-part of Ser. No. 228,761, Apr. 18, 1994, abandoned.

[51] Int. Cl.[6] ..... H01H 5/00

[52] U.S. Cl. ..... 200/400; 200/401; 74/155

[58] Field of Search ..... 200/400, 401; 74/155, 148, 149, 150, 152, 2; 185/40 R

[56] References Cited

U.S. PATENT DOCUMENTS 2,581,181 1/1952 Favre .
3,652,815 3/1972 Davis ..... 200/400
4,001,742 1/1977 Jencks et al. .
4,167,488 9/1979 Acampora et al. ..... 200/400
4,801,907 1/1989 Kelaita, Jr. et al. .

OTHER PUBLICATIONS

Castonguay et al "Rating Module Unit for High Ampere–Rated Circuit Breader" U.S.SN: 08/203062 filed Feb. 28, 1994 (Our Docket: 41PR–7124).
U.S. application No. 08/202,140, Castonguay et al., filed Feb. 24, 1994.
U.S. application No. 08/214,522, Castonguay et al., filed Mar. 18, 1994.
U.S. application No. 08/218,287, Castonguay et al., filed Mar. 28, 1994.

*Primary Examiner*—David J. Walczak
*Attorney, Agent, or Firm*—Richard A. Menelly; Carl B. Horton

[57] ABSTRACT

This invention relates to a high ampere-rated circuit breaker which meets the electrical code requirements of the world market. The charging of the powerful operating springs controlling the circuit breaker contacts is accomplished by operation of a ratchet and pawl assembly. A reset system interfaces with the charging system to reset the charging system after the operating springs have been discharged.

19 Claims, 6 Drawing Sheets

SYSTEM FOR RESETTING HIGH AMPERE-RATED CIRCUIT BREAKER OPERATING SPRINGS

This is a continuation-in-part of application Ser. No. 08/228,761 filed on Apr. 18, 1994, now abandon.

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Pat. No. 5,424,701 entitled "Operating Mechanism for High Ampere-Rated Circuit Breaker" describes an operating mechanism capable of immediately resetting the circuit breaker operating mechanism to reclose the contacts without having to recharge the circuit breaker operating springs immediately after opening the circuit breaker contacts.

U.S. patent application Ser. No. 08/203,062 filed Feb. 28, 1994 entitled "Rating Module Unit for High Ampere-Rated Circuit Breaker" describes a circuit breaker closing spring modular unit whereby the circuit breaker operating springs are contained within a separate unit from the operating mechanism and can be installed within the circuit breaker enclosure without disturbing the operating mechanism assembly.

U.S. patent application Ser. No. 08/214,522 filed Mar. 18, 1994 entitled "Handle Operator Assembly for High Ampere-Rated Circuit Breaker" describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

U.S. patent application Ser. No. 08/210,187 filed Mar. 28, 1994 entitled "A Latching Arrangement for High Ampere-rated Circuit Breaker Operating Springs" describes a two stage latching arrangement that insures that the operating springs are first brought to their fully charged condition and then allowed to operate free from the ratchet and pawl assembly.

After the circuit breaker operating springs have responded to close the circuit breaker contacts, the springs must be re-charged to their stored energy condition to provide closing force after the opening springs have separated the circuit breaker contacts upon the occurrence of an overcurrent condition.

One purpose of this invention is to mechanically ensure that the circuit breaker closing springs have completely responded before allowing resetting of the charging system to re-charge the closing springs.

SUMMARY OF THE INVENTION

A reset assembly interfaces between the circuit breaker closing shaft and the closing spring latching assembly to isolate the latching assembly components from the impact forces generated by the closing shaft during the closing operation. The reset assembly includes a reset lever that interacts between the closing cradle on the latching assembly and the closing gear arranged on the closing shaft.

DESCRIPTION OF THE PREFERRED EMBODIMENT

Figure 1:
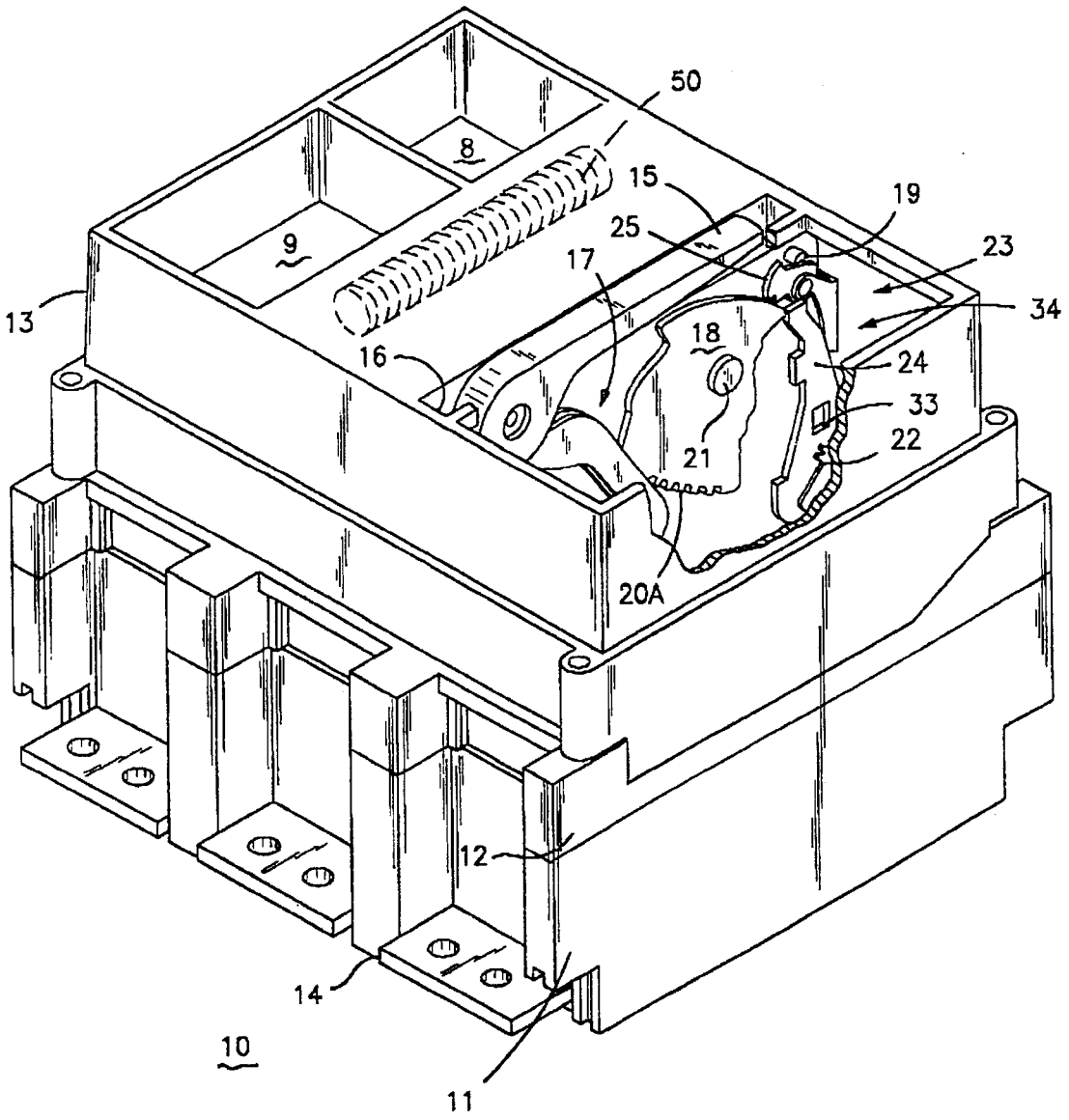
FIG. 1 is a top perspective view of a high ampere-rated circuit breaker with a portion of the circuit breaker cover removed to depict the operating springs reset assembly.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 8 on the top surface of the top cover 13. Although not shown herein, the trip unit is similar to that described within U.S. Pat. No. 2,581,181 and interacts further with an accessory contained within the accessory recess 9 to provide a range of protection and control functions such as described, for example within U.S. Pat. No. 4,801,907. The operating mechanism as described within the aforementioned U.S. patent application Ser. No. 08/203,062 includes a closing shaft 21 which provides the forces required to charge the powerful operating mechanism closing springs 50. The operating handle 15 located within the handle recess 16 provides manual means for charging the operating mechanism springs through operation of a handle drive assembly 17 and a handle drive gear 18 which includes a series of handle drive teeth 20*a* that are driven by the handle drive assembly and a separate series of handle locking teeth 20 (FIG. 2) that interact with a locking pawl 22 to restrain the handle drive gear 18 from reverse rotation during the operating spring charging process as described in the aforementioned U.S. patent application Ser. No. 08/214,522. A two stage operating springs latching assembly 23 interacts with the locking pawl 22 to controllably allow the locking pawl to engage the locking teeth 20 to prevent rotation of the closing shaft 21 while the operating springs are being charged. The latching assembly includes a closing cradle 24, an intermediate latch 25 at the top of the closing cradle 24 and a latch release pin 19 at the top of the intermediate latch. The rectangular slot 33 in the closing cradle interacts with the reset assembly in the manner to be described below.

Figure 2:
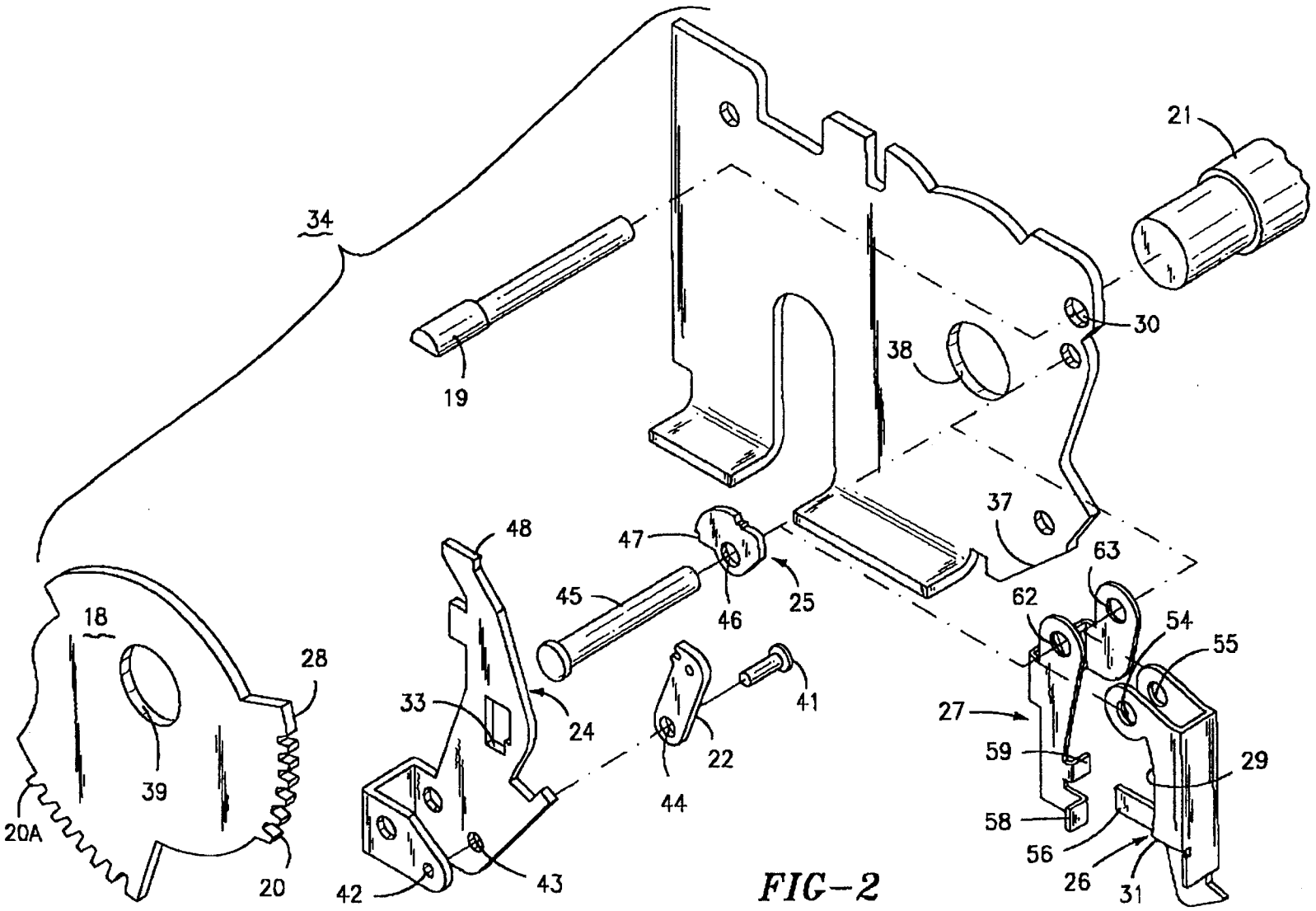
FIG. 2 is a top perspective view of the reset assembly of FIG. 1 with the reset components in isometric projection.

The components of the reset assembly 34 are assembled on the operating mechanism side frame 37 in the manner dipicted in FIG. 2. The closing cradle 24 is assembled to the side frame 37 and the locking pawl 22 is pivotally assembled on the closing cradle by means of the pin 41 and thru-holes 42, 43, 44. The locking pawl 22 is spring-biased in the counter-clockwise direction by a torsion spring (not shown). The intermediate latch 25 is attached to the sideframe 37 on top of the closing cradle 24 by means of the pivot pin 45 and thru-hole 46 so that the slot 47 on the intermediate latch interfaces with the hook 48 formed on the top of the closing cradle 24. The latch release pin 19 extends through the opening 30 in the side frame 37 to release the intermediate latch 25 in the manner described in the aforementioned U.S. patent application Ser. No. 08/210,287. The reset lever 26 and lock-out lever 27 are interconnected with the side frame 37 and the intermediate latch 25 by means of the common pivot pin 45 and thru-holes 54, 55, 62, 63. The rectangular slot 33 on the closing cradle 24 captures the lock-out tab 58 extending from the bottom of the lock-out lever 27 and interacts therewith in the manner to be described below. The handle drive gear 18 is positioned on the end of the closing shaft 21 which extends through the opening 38 in the side frame 37 and through the opening 39 in the handle drive gear 18. In this arrangement, the cam surface 28 above the locking teeth 20 on the handle drive gear 18 apart from the handle drive teeth 20A interacts with the cam follower surfaces 29, 31 formed on the reset lever 26 and the interface tab 59 on the lock-out lever 27 interacts with the guide extension 56 on the reset lever 26 to accurately set the relationship between the locking pawl 22 and the handle drive gear 18, in the manner best seen by referring to FIGS. 3–6.

Figure 3:
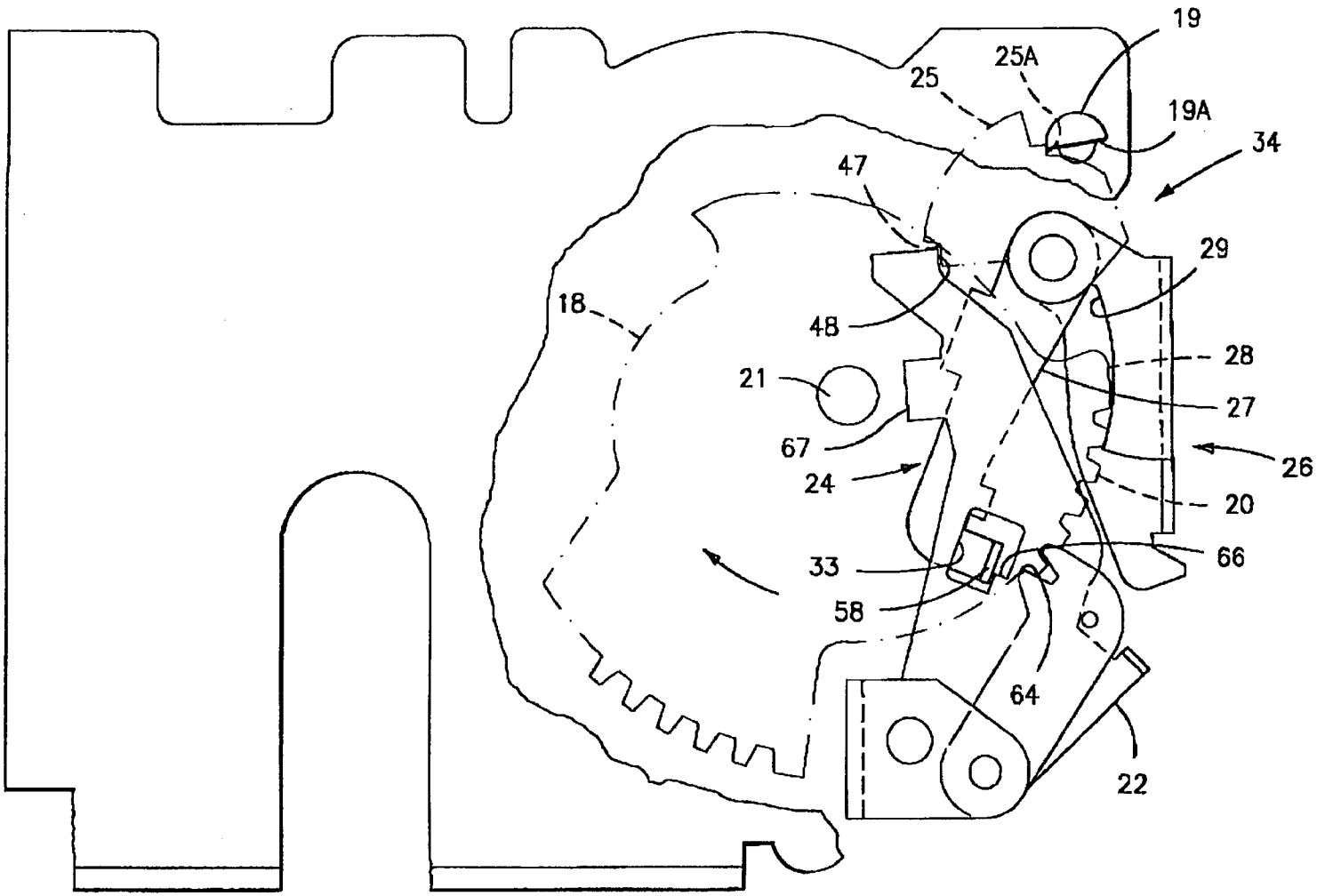
FIG. 3 is an enlarged side view of the reset assembly of FIG. 1 attached to a side frame and with the handle drive gear in the charged position.

When the circuit breaker operating mechanism closing springs described earlier are in their fully charged condition, the handle drive gear 18 is in the position depicted in FIG. 3. The retainer groove 64 on the locking pawl 22 is in engagement with the locking teeth 20 on the handle drive gear 18. The lock-out tab 58 on the lock-out lever 27 within the reset assembly 34 is at the bottom of the rectangular slot 33 in the closing cradle 24 beneath the step 66 formed in the back edge of the slot. The tab 67 on the closing cradle 24 is away from the closing shaft 21 and the cam surface 28 on the drive gear 18 rests against the cam follower surface 29 on the reset lever 26. The latching surface 19A on the latch release pin 19 rests against corresponding surface 25A on intermediate latch 25 and the slot surface 47 on the intermediate latch 25 is in engagement with the hook 48 on the top of the closing cradle 24. When the latch release pin 19 is later rotated away from the intermediate latch 25 to allow the closing shaft 21 to rotate free of the locking pawl 22, the reset assembly 34 responds to prevent the pawl from returning into contact with the drive gear 18 until the drive gear is in the proper position. The position logic of the drive gear is transmitted to the reset assembly 34 in the manner best seen by now referring to FIGS. 4–6.

Figure 4:
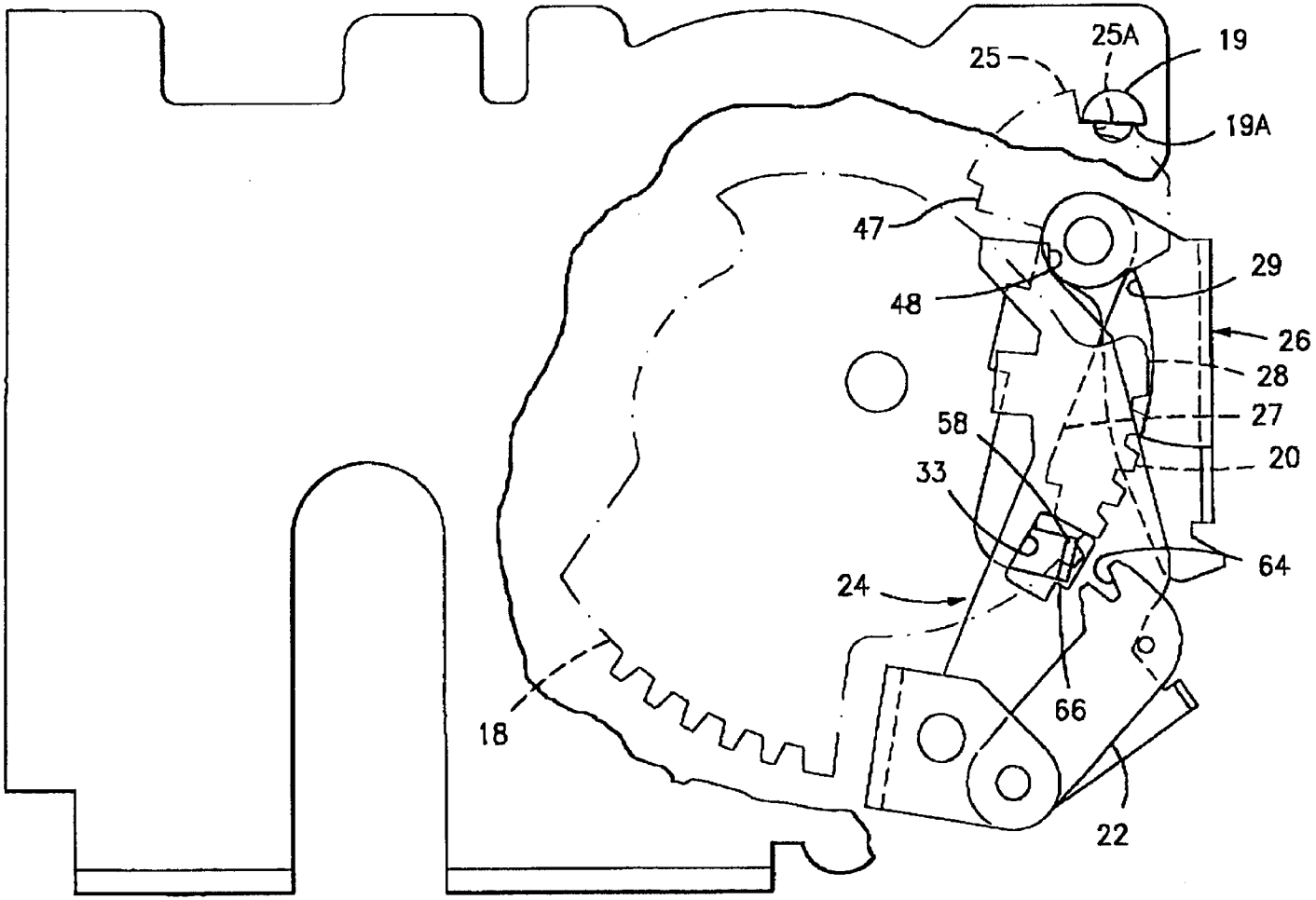
FIG. 4 is an enlarged side view of the reset assembly of FIG. 1 with the handle drive gear in the first stage of the closing operation.

In FIG. 4, with the latching surface 19A on the latch release pin 19 away from the latch surface 25*a* on the intermediate latch 25, closing cradle 24 is forced by the clockwise rotation of the handle drive gear 18, due to the discharging of the closing springs, 50 (FIG. 2) to rotate in the clockwise direction which rotates the intermediate latch surface 47 away from the hook 48. The retainer groove 64 on the locking pawl 22 moves away from the locking teeth 20 on the handle drive gear 18. The cam surface 28 on the handle drive gear 18 is against the cam follower surface 29 on the reset lever 26. The lockout tab 58 on lockout lever 27, which is spring biased in a counter-clockwise direction, is positioned on the step 66 within the rectangular slot 33 in the closing cradle 24. The interaction of lockout tab 58 and the step 66 as shown in FIG. 4, locks the closing cradle 24 from rotating back in the counter-clockwise direction. This locked position insures that the retainer groove 64 cannot return into engagement with the locking teeth 20 of the handle drive gear 18 until the drive gear has completed its closing cycle.

Figure 5:
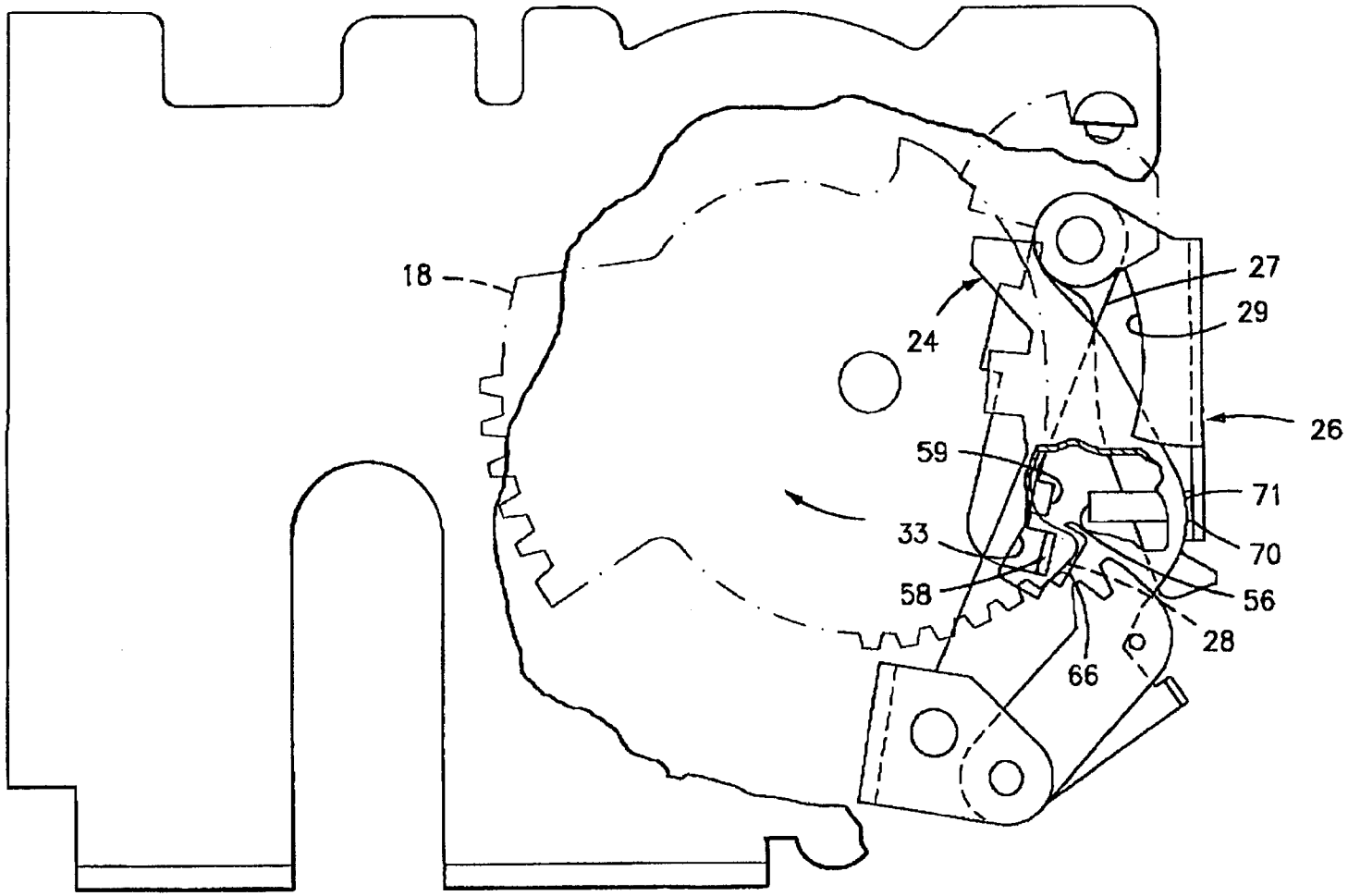
FIG. 5 is an enlarged side view of the reset assembly of FIG. 1 with the handle drive gear in the final stage of the closing operation and the reset assembly partially reset.

In the second stage of the reset operation, the handle drive gear 18 rotates to the position shown in FIG. 5, such that the cam surface 28 on the handle drive gear 18 is away from the cam follower surface 29 on the reset lever 26 allowing the reset lever to rotate in the clockwise direction under the return bias provided by the reset lever torsion spring (not shown). Cam follower surface 29 on the reset lever 26 momentarily contacts the interface tab 59 of the lockout lever 27 forcing the lockout tab 58 out of engagement with the step 66 within the slot 33 of the closing cradle 24. This unlocks the closing cradle 24 from the locked position shown earlier in FIG. 4.

Figure 6:
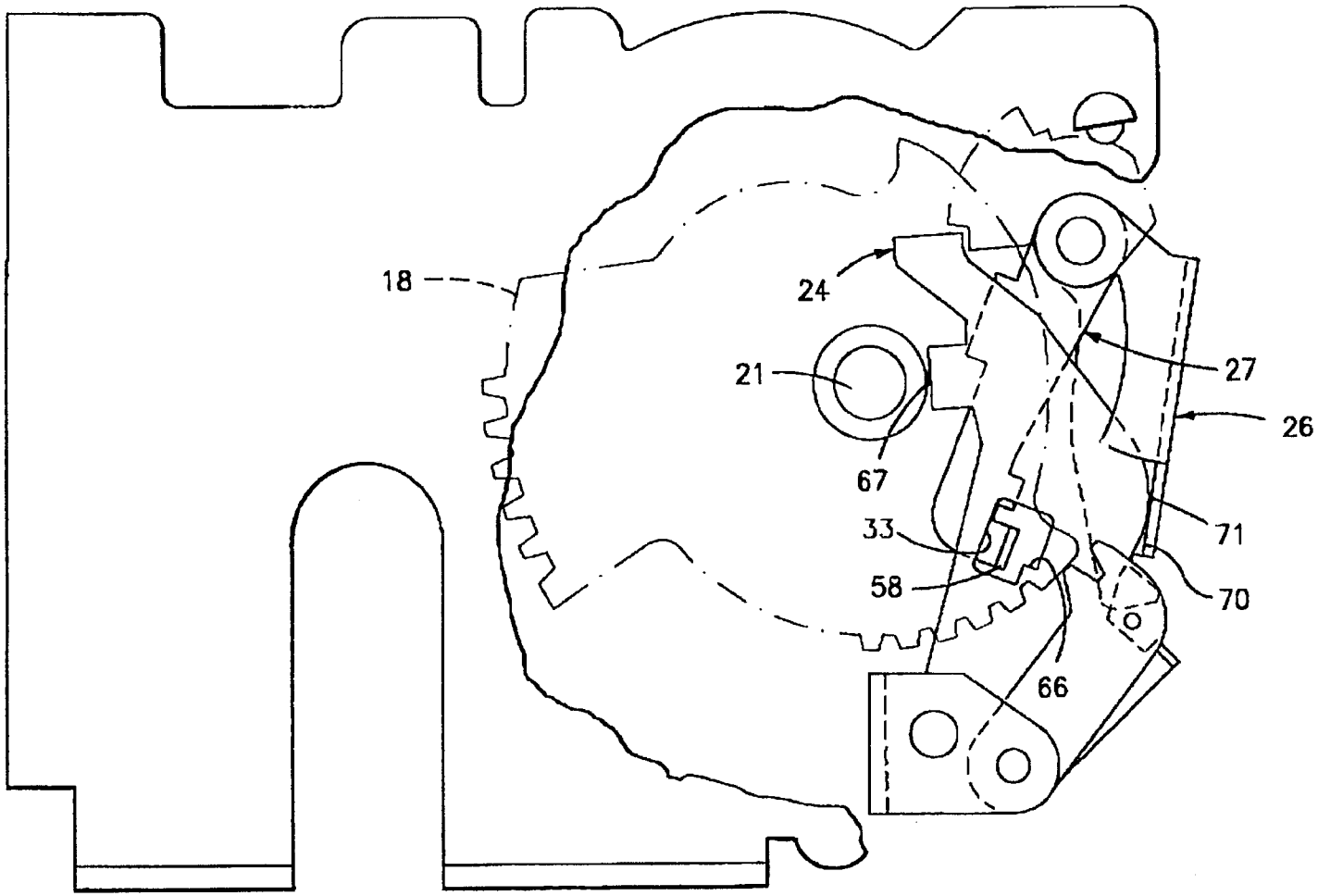
FIG. 6 is an enlarged side view of the reset assembly of FIG. 2 with the handle drive gear in the final stage of the closing operation and the reset assembly in its full reset position.

In the third stage of the reset operation shown in FIG. 6, the lock-out tab 58 on the lock-out lever 27 is away from the step 66 in the rectangular slot 33 in the closing cradle 24 and further rotation of the reset lever 26 causes the surface 70 of the reset lever 26 to interact with the cam surface 71 of the closing cradle, 24, thus driving the closing cradle 24 in a counter-clockwise direction allowing the tab 67 on the closing cradle 24 to return against the closing shaft 21. Rotation of the handle drive gear 18 back to its charged position rotates the closing cradle 24, resetting the reset lever 26 and lock-out lever 27 to the fully charged position shown earlier in FIG. 3.

A circuit breaker closing spring reset assembly has been described herein whereby the positional logic from the closing gear controls the position of the closing cradle and prevents the pawl from being driven against the closing gear when the closing springs become discharged.

We claim:

1. An industrial-rated circuit breaker for high level overcurrent protection comprising:

an insulative base;

an insulative cover above said base, said cover enclosing a closing shaft and a handle drive gear arranged for charging a circuit breaker closing spring;

a handle connecting with said closing shaft said handle drive gear and a locking pawl allowing an operator to provide closing forces for charging said closing spring;

an intermediate latch arrangement operatively connecting said locking pawl with said drive gear when said closing spring is receiving said forces and releasing said locking pawl from said handle drive gear when said closing spring becomes fully charged;

a reset assembly within said cover interacting between said handle drive gear and said locking pawl to operatively connect said locking pawl with said handle drive gear when applying said closing forces and disconnect said locking pawl from said handle drive gear when said closing spring is fully charged; and a closing cradle interacting with said intermediate latch and said reset assembly for initiating charging of said closing spring.

2. The circuit breaker of claim 1 wherein said reset assembly includes a lock-out lever pivotally arranged with said closing cradle, said lock-out lever including a lock-out tab and said closing cradle including a slot, said lock-out tab being received within said slot.

3. The circuit breaker of claim 2 including a reset lever pivotally arranged with said lock-out lever, said lock-out lever including an interface tab contacting a bottom part of a reset lever whereby said reset lever and said lockout lever rotate in unison.

4. The circuit breaker of claim 3 wherein said handle drive gear includes a plurality of locking teeth defined on a perimeter thereof, and said locking pawl includes a retainer groove capturing said locking teeth to thereby prevent said handle drive gear from rotating in a reverse direction.

5. The circuit breaker of claim 4 wherein said reset lever includes a cam-follower surface and said handle drive gear defines a cam surface above said locking teeth, whereby said cam surface contacts said cam-follower surface and moves said reset lever away from said lock-out lever.

6. The circuit breaker of claim 3 wherein said slot on said closing cradle includes a step, said lock-out lever being received on said step to thereby retain said locking pawl from contacting said handle drive gear.

7. The circuit breaker of claim 1 wherein said locking pawl is pivotally attached to said closing cradle.

8. The circuit breaker of claim 1 wherein said closing cradle defines a hook at a top part thereof, and said intermediate latch defines a groove surface, said hook being captured by said groove surface to deter rotation of said closing cradle.

9. The circuit breaker of claim 1 including a latch pin arranged over said intermediate latch, said latch pin further including a shaped pin surface, said intermediate latch including a shaped latching surface, whereby said intermediate latch is prevented from rotating when said shaped pin surface is in contact with said shaped latching surface and said intermediate latch becomes rotated when said shaped pin surface is out of contact with said shaped latching surface.

10. An industrial-rated circuit breaker for high level overcurrent protection comprising:

an insulative base;

an insulative cover above said base, said cover enclosing a closing shaft and a handle drive gear arranged for charging a circuit breaker closing spring;

a handle connecting with said closing shaft, said handle drive gear and a locking pawl allowing an operator to provide forces required to charge said closing spring;

an intermediate latch operatively connecting said locking pawl with said drive gear when said closing spring is receiving said forces and releasing said locking pawl from said handle drive gear when said closing spring becomes fully charged; and a reset assembly within said cover interacting between said handle drive gear and a closing cradle to operatively connect said locking pawl with said handle drive gear, said reset assembly further includes a lock-out lever and a reset lever.

11. The circuit breaker of claim 10 wherein said closing cradle interacts with said closing intermediate latch and said reset assembly for initiating charging of said closing spring.

12. The circuit breaker of claim 11 wherein said lock-out lever is pivotally arranged with said intermediate cradle, said lock-out lever including a lock-out tab and said closing cradle including a slot, said lock-out tab being received within said slot.

13. The circuit breaker of claim 12 wherein said reset lever is pivotally arranged with said lock-out lever, said lock-out lever including an interface tab contacting a bottom part of said reset lever whereby said reset lever and said lock-out lever rotate in unison.

14. The circuit breaker of claim 13 wherein said slot on said closing cradle includes a step, said lock-out lever being received on said step to thereby retain said closing pawl from contacting said handle drive gear.

15. The circuit breaker of claim 11 wherein said locking pawl is pivotally attached to said closing cradle.

16. The circuit breaker of claim 11 wherein said closing cradle defines a hook at a top part thereof, and said intermediate latch defines a groove, surface said hook being captured within said groove surface to deter rotation of said closing cradle.

17. The circuit breaker of claim 11 wherein said handle drive gear includes a plurality of locking teeth defined on a perimeter thereof, and said locking pawl includes a retainer groove capturing said locking teeth to thereby prevent said handle drive gear from rotating in a reverse direction.

18. The circuit breaker of claim 17 wherein said reset lever includes a camfollower surface and said handle drive gear defines a cam surface above said locking teeth, whereby said cam surface contacts said cam follower surface and moves said reset lever away from said lock-out lever.

19. The circuit breaker of claim 11 including a latch pin arranged over said intermediate latch, said latch pin further including a shaped pin surface, said intermediate latch including a shaped latching surface, whereby said intermediate latch is prevented from rotating when said shaped pin surface is in contact with said shaped latching surface and said intermediate latch becomes rotated when said shaped pin surface is out of contact with said shaped latching surface.

* * * * *

UNITED STATES PATENT AND TRADEMARK OFFICE

CERTIFICATE OF CORRECTION

PATENT NO. : 5,651,451

DATED : July 29, 1997

INVENTOR(S) : Roger N. Castonguay, et al

It is certified that error appears in the above-identified patent and that said Letters Patent is hereby corrected as shown below:

In the cover page, Assignee section insert --General Electric Company, New York, NY--

Signed and Sealed this

Fourth Day of July, 2000

*Attest:*

*Attesting Officer*

Q. TODD DICKINSON

*Director of Patents and Trademarks*